US011156052B2

(12) United States Patent
Al-Mousa et al.

(10) Patent No.: US 11,156,052 B2
(45) Date of Patent: Oct. 26, 2021

(54) WELLBORE TOOL ASSEMBLY TO OPEN COLLAPSED TUBING

(71) Applicant: Saudi Arabian Oil Company, Dhahran (SA)

(72) Inventors: Ahmed Al-Mousa, Dhahran (SA); Ahmed A. Al-Ramadhan, Dammam (SA); Qadir Looni, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 8 days.

(21) Appl. No.: 16/730,670

(22) Filed: Dec. 30, 2019

(65) Prior Publication Data

US 2021/0198965 A1 Jul. 1, 2021

(51) Int. Cl.
*E21B 29/10* (2006.01)
*E21B 33/128* (2006.01)

(52) U.S. Cl.
CPC ..... *E21B 29/10* (2013.01); *E21B 33/1285* (2013.01)

(58) Field of Classification Search
CPC ..... E21B 29/10; E21B 43/103; E21B 43/105; E21B 33/1285
See application file for complete search history.

(56) References Cited

U.S. PATENT DOCUMENTS 880,404 A 2/1908 Sanford
1,591,264 A 7/1926 Baash
1,789,993 A 1/1931 Switzer
1,896,482 A 2/1933 Crowell
1,949,498 A 3/1934 Frederick et al.
2,121,002 A 6/1938 Baker
2,121,051 A 6/1938 Ragan et al.
2,187,487 A 1/1940 Burt
2,189,697 A 2/1940 Baker
2,222,233 A 11/1940 Mize
2,286,075 A 6/1942 Evans
(Continued)

FOREIGN PATENT DOCUMENTS

AU 636642 5/1993
AU 2007249417 11/2007
(Continued)

OTHER PUBLICATIONS

Bruton et al., "Whipstock Options far Sidetracking," Oilfield Review, vol. 26, No. 1, Spring 2014, 10 pages.
(Continued)

*Primary Examiner* — Michael R Wills, III
(74) *Attorney, Agent, or Firm* — Fish & Richardson P.C.

(57) ABSTRACT

Wellbore tool assembly to open collapsed tubing includes a chisel head having a first end configured to be positioned within an end of a collapsed tubing portion of a tubular member. The chisel head has a second end opposite the first end. The second end has an outer diameter smaller than an outer diameter of an uncollapsed tubing portion of the tubular member. The chisel head is configured to expand a diameter of the collapsed tubing portion responsive to a movement of the chisel head toward the collapsed tubing portion. The assembly includes a packer attached to the chisel head. The packer is configured to expand responsive to fluidic pressure and to further expand the diameter of the collapsed tubing portion.

19 Claims, 4 Drawing Sheets

(56) References Cited

U.S. PATENT DOCUMENTS 2,304,793 A 12/1942 Bodine
2,316,402 A 4/1943 Canon
2,327,092 A 8/1943 Botkin
2,411,260 A 11/1946 Glover et al.
2,546,978 A 4/1951 Collins et al.
2,672,199 A 3/1954 McKenna
2,707,998 A 5/1955 Baker et al.
2,728,599 A 12/1955 Moore
2,751,010 A 6/1956 Trahan
2,881,838 A 4/1959 Morse et al.
2,912,053 A 11/1959 Bruekelman
2,912,273 A 11/1959 Chadderdon et al.
2,915,127 A 12/1959 Abendroth
2,965,175 A 12/1960 Ransom
2,965,177 A 12/1960 Le Bus et al.
3,116,799 A 1/1964 Lemons
3,147,536 A 9/1964 Lamphere
3,191,677 A * 6/1965 Kinley ..... E21B 43/105 166/277
3,225,828 A 12/1965 Wisenbaker et al.
3,369,603 A 2/1968 Trantham
3,381,748 A 5/1968 Peters et al.
3,382,925 A 5/1968 Jennings
3,667,721 A 6/1972 Vujasinovie
3,897,038 A 7/1975 Le Rouax
3,915,426 A 10/1975 Le Rouax
4,030,354 A 6/1977 Scott
4,042,019 A 8/1977 Henning
4,059,155 A 11/1977 Greer
4,099,699 A 7/1978 Allen
4,190,112 A 2/1980 Davis
4,254,981 A 3/1981 Harris
4,276,931 A 7/1981 Murray
4,296,822 A 10/1981 Ormsby
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,467,996 A 8/1984 Baugh
4,538,684 A 9/1985 Sheffield
4,562,888 A 1/1986 Collet
4,603,578 A 8/1986 Stoltz
4,696,502 A 9/1987 Desai
4,834,184 A 5/1989 Streich et al.
4,869,321 A 9/1989 Hamilton
4,898,245 A 2/1990 Braddick
4,953,617 A 9/1990 Ross
5,012,863 A 5/1991 Springer
5,117,909 A 6/1992 Wilton et al.
5,129,956 A 7/1992 Christopher et al.
5,176,208 A 1/1993 Lalande et al.
5,197,547 A 3/1993 Morgan
5,295,541 A 3/1994 Ng et al.
5,330,000 A 7/1994 Givens et al.
5,348,095 A * 9/1994 Worrall ..... E21B 43/105 166/380
5,358,048 A 10/1994 Brooks
5,507,346 A 4/1996 Gano et al.
5,580,114 A 12/1996 Palmer
5,678,635 A 10/1997 Dunlap et al.
5,833,001 A 11/1998 Song et al.
5,842,518 A 12/1998 Soybel et al.
5,924,489 A 7/1999 Hatcher
5,944,101 A 8/1999 Hearn
6,138,764 A 10/2000 Scarsdale et al.
6,247,542 B1 6/2001 Kruspe et al.
6,276,452 B1 8/2001 Davis et al.
6,371,204 B1 4/2002 Singh et al.
6,491,108 B1 12/2002 Slup et al.
6,595,289 B2 7/2003 Tumlin et al.
6,688,386 B2 2/2004 Cornelssen
6,768,106 B2 7/2004 Gzara et al.
6,808,023 B2 10/2004 Smith et al.
6,854,521 B2 2/2005 Echols et al.
6,899,178 B2 5/2005 Tubel
7,049,277 B2 5/2006 Sinclair et al.
7,096,950 B2 8/2006 Howlett et al.
7,117,941 B1 * 10/2006 Gano ..... E21B 43/105 166/207
7,117,956 B2 10/2006 Grattan et al.
7,128,146 B2 * 10/2006 Baugh ..... E21B 43/105 166/206
7,174,764 B2 2/2007 Oosterling et al.
7,188,674 B2 3/2007 McGovern, III et al.
7,188,675 B2 3/2007 Reynolds
7,231,975 B2 6/2007 Lavaure et al.
7,249,633 B2 7/2007 Ravensbergen et al.
7,284,611 B2 10/2007 Reddy et al.
7,383,889 B2 * 6/2008 Ring ..... E21B 43/105 166/121
7,398,832 B2 7/2008 Brisco
7,405,182 B2 7/2008 Verrett
7,424,909 B2 9/2008 Roberts et al.
7,488,705 B2 2/2009 Reddy et al.
7,497,260 B2 3/2009 Telfer
7,533,731 B2 * 5/2009 Corre ..... E21B 29/10 166/187
7,591,305 B2 9/2009 Brookey et al.
7,600,577 B2 10/2009 Slup et al.
7,712,527 B2 5/2010 Roddy
7,762,323 B2 7/2010 Frazier
7,802,621 B2 9/2010 Richards et al.
7,878,240 B2 * 2/2011 Garcia ..... E21B 43/103 166/207
7,934,552 B2 5/2011 La Rovere
7,965,175 B2 6/2011 Yamano
8,002,049 B2 8/2011 Keese et al.
8,069,916 B2 12/2011 Giroux et al.
8,157,007 B2 * 4/2012 Nicolas ..... E21B 43/14 166/207
8,376,051 B2 2/2013 McGrath et al.
8,453,724 B2 6/2013 Zhou
8,496,055 B2 7/2013 Mootoo et al.
8,579,024 B2 11/2013 Mailand et al.
8,770,776 B1 7/2014 Nish et al.
9,109,433 B2 8/2015 DiFoggio et al.
9,133,671 B2 9/2015 Kellner
9,212,532 B2 12/2015 Leuchtenberg et al.
9,359,861 B2 6/2016 Burgos
9,410,066 B2 8/2016 Ghassemzadeh
9,416,617 B2 8/2016 Wiese et al.
9,551,200 B2 1/2017 Read et al.
9,574,417 B2 2/2017 Laird et al.
9,657,213 B2 5/2017 Murphy et al.
10,280,706 B1 5/2019 Sharp, III
10,301,898 B2 5/2019 Orban
10,787,888 B2 * 9/2020 Andersen ..... E21B 43/105
2002/0053428 A1 5/2002 Maples
2002/0060079 A1 * 5/2002 Metcalfe ..... B21D 39/04 166/387
2002/0195252 A1 * 12/2002 Maguire ..... E21B 43/106 166/380
2003/0047312 A1 3/2003 Bell
2003/0132224 A1 7/2003 Spencer
2003/0150608 A1 * 8/2003 Smith, Jr. ..... E21B 43/105 166/118
2003/0221840 A1 * 12/2003 Whitelaw ..... E21B 43/103 166/380
2004/0216891 A1 * 11/2004 Maguire ..... E21B 43/106 166/380
2005/0167097 A1 8/2005 Sommers et al.
2007/0137528 A1 6/2007 Le Roy-Ddelage et al.
2007/0181304 A1 8/2007 Rankin et al.
2008/0236841 A1 10/2008 Howlett et al.
2008/0251253 A1 10/2008 Lumbye
2009/0194290 A1 8/2009 Parks et al.
2009/0250220 A1 10/2009 Stamoulis
2010/0193124 A1 * 8/2010 Nicolas ..... E21B 29/10 156/294
2010/0270018 A1 10/2010 Howlett
2011/0036570 A1 2/2011 La Rovere et al.

(56) References Cited

U.S. PATENT DOCUMENTS

| | | | | |
|---|---|---|---|---|
| 2011/0056681 | A1 | 3/2011 | Khan | |
| 2011/0067869 | A1 | 3/2011 | Baur et al. | |
| 2011/0168411 | A1 | 7/2011 | Braddick | |
| 2011/0259609 | A1 | 10/2011 | Hessels et al. | |
| 2011/0278021 | A1 | 11/2011 | Travis et al. | |
| 2012/0012335 | A1 | 1/2012 | White et al. | |
| 2012/0118571 | A1 | 5/2012 | Zhou | |
| 2012/0170406 | A1 | 7/2012 | DiFoggio et al. | |
| 2013/0140022 | A1* | 6/2013 | Leighton | E21B 43/105 166/277 |
| 2013/0240207 | A1 | 9/2013 | Frazier | |
| 2013/0296199 | A1 | 11/2013 | Ghassemzadeh | |
| 2014/0175689 | A1* | 6/2014 | Mussig | E21B 29/10 264/36.17 |
| 2015/0152704 | A1* | 6/2015 | Tunget | E21B 28/00 166/254.2 |
| 2016/0237810 | A1 | 8/2016 | Beaman et al. | |
| 2016/0281458 | A1 | 9/2016 | Greenlee | |
| 2016/0305715 | A1 | 10/2016 | Harris et al. | |
| 2017/0044864 | A1 | 2/2017 | Sabins et al. | |
| 2017/0058628 | A1 | 3/2017 | Van Wijk et al. | |
| 2017/0067313 | A1 | 3/2017 | Connell et al. | |
| 2018/0187498 | A1 | 7/2018 | Soto et al. | |
| 2018/0245427 | A1 | 8/2018 | Jimenez et al. | |
| 2019/0024473 | A1 | 1/2019 | Arefi | |
| 2019/0049017 | A1 | 2/2019 | McAdam | |
| 2019/0316424 | A1 | 10/2019 | Robichaux et al. | |

FOREIGN PATENT DOCUMENTS

| | | |
|---|---|---|
| CA | 2734032 | 6/2016 |
| DK | 2236742 | 8/2017 |
| EP | 2119867 | 11/2009 |
| GB | 2392183 | 2/2004 |
| GB | 7453779 | 1/2009 |
| GB | 2492663 | 1/2014 |
| NO | 333538 | 7/2013 |
| WO | WO 1989012728 | 12/1989 |
| WO | WO 7002090711 | 11/2002 |
| WO | WO 7010132807 | 11/2010 |
| WO | WO 2012164023 | 12/2012 |
| WO | WO 2019132877 | 7/2019 |

OTHER PUBLICATIONS

Scribd [online], "Milling Practices and Procedures," retrieved from URL <https://www.scribd.com/document/358420338/Milling-Rev-2-Secured>, 80 pages.

Tam International Inflatable and Swellable Packers, "TAM Scab Liner brochure," Tam International, available on or before Nov. 15, 2016, 4 pages.

PCT International Search Report and Written Opinion in International Appln. No. PCT/US2020/065947, dated Mar. 30, 2021, 13 pages.

* cited by examiner

WELLBORE TOOL ASSEMBLY TO OPEN COLLAPSED TUBING

TECHNICAL FIELD

This disclosure relates to wellbore tools, for example, a wellbore tool to access tubing positioned within a wellbore.

BACKGROUND

Hydrocarbons entrapped in subsurface reservoirs are produced to the surface by forming wellbores in the reservoirs and producing the hydrocarbons to the surface through the wellbores. Producing hydrocarbons through a wellbore involves forming the wellbore and positioning tubing within the wellbore through which the hydrocarbons flow to the surface, or through which fluids are floored into the subsurface reservoir, or both. A tubing, for example, production tubing, is a tubular element (that is, an elongated tube). The tubing can be made of a material that has properties to operate as intended under subsurface conditions, for example, subsurface pressures and temperatures. The material properties of the tubing also allow the tubing to withstand effects, for example, corrosive effects, of the produced hydrocarbons and other fluids flowing through the tube.

Sometimes, a portion of the tubing collapses. For example, the formation pressure in the subsurface reservoir can increase to a level that causes a portion of the tubing to collapse. Collapsed tubing needs to be accessed from and retrieved to the surface to continue wellbore operations.

SUMMARY

This disclosure describes a wellbore tool assembly to open collapsed tubing.

Certain aspects of the subject matter described here can be implemented as a wellbore tool assembly. The assembly includes a chisel head having a first end configured to be positioned within an end of a collapsed tubing portion of a tubular member. The chisel head has a second end opposite the first end. The second end has an outer diameter smaller than an outer diameter of an uncollapsed tubing portion of the tubular member. The chisel head is configured to expand a diameter of the collapsed tubing portion responsive to a movement of the chisel head toward the collapsed tubing portion. The assembly includes a packer attached to the chisel head. The packer is configured to expand responsive to fluidic pressure and to further expand the diameter of the collapsed tubing portion.

An aspect that can be combined with any of the other aspects includes the following features. At the first end, the chisel head has a substantially rectangular cross-section with a larger side dimension substantially equal to the outer diameter of the second end and a smaller side dimension smaller than a width of the collapsed tubing portion. The smaller side dimension is sufficient for the chisel head to be positioned within the end of the collapsed tubing portion.

An aspect that can be combined with any of the other aspects includes the following features. The assembly includes a piston attached to the chisel head. The piston is configured to cause the movement of the chisel head toward the collapsed tubing portion.

An aspect that can be combined with any of the other aspects includes the following features. The assembly includes a housing within which the piston is housed. The packer is attached between the housing and the chisel head.

An aspect that can be combined with any of the other aspects includes the following features. The assembly includes multiple anchoring slips attached to the housing. The multiple anchoring slips are configured, when activated, to anchor the housing to the uncollapsed tubing portion of the tubular member.

An aspect that can be combined with any of the other aspects includes the following features. The multiple anchoring slips are configured to be activated responsive to application of fluidic pressure and deactivated responsive to removal of the fluidic pressure.

An aspect that can be combined with any of the other aspects includes the following features. With the housing anchored to the uncollapsed tubing portion of the tubular member, the piston is configured to cause the chisel head and the packer to move toward the collapsed tubing portion.

An aspect that can be combined with any of the other aspects includes the following features. The assembly includes a swivel attached between the housing and the packer. The swivel is configured to permit the packer and the chisel head to rotate freely from the housing.

An aspect that can be combined with any of the other aspects includes the following features. The packer and the chisel head are rotationally coupled.

Certain aspects of the subject matter described here can be implemented as a method. A chisel head at an end of a wellbore tool assembly is positioned within a collapsed tubing portion of a tubular member that includes an uncollapsed tubing portion. The chisel head is driven into the collapsed tubing portion to expand the collapsed tubing portion. After driving the chisel head into the collapsed tubing portion, a packer attached to the chisel head is expanded to further expand the collapsed tubing portion.

An aspect that can be combined with any of the other aspects includes the following features. The chisel head has a substantially rectangular cross-section with a larger side dimension and a smaller side dimension smaller than a width of the collapsed tubing portion. The smaller side dimension is sufficient for the chisel head to be positioned within the end of the collapsed tubing portion. Positioning the chisel head within the collapsed tubing portion includes rotating the chisel head within the uncollapsed tubing portion relative to the collapsed tubing portion until the smaller side dimension of the chisel head aligns with the width of the collapsed tubing portion.

An aspect that can be combined with any of the other aspects includes the following features. The packer and the chisel head are rotationally coupled. Rotating the chisel head includes rotating the packer and the chisel head together.

An aspect that can be combined with any of the other aspects includes the following features. The wellbore tool assembly includes a piston attached to the packer and the chisel head. Driving the chisel head into the collapsed tubing portion includes extending the piston toward the collapsed tubing portion.

An aspect that can be combined with any of the other aspects includes the following features. The wellbore tool assembly is anchored within the uncollapsed tubing portion before extending the piston toward the collapsed tubing portion.

An aspect that can be combined with any of the other aspects includes the following features. The wellbore tool assembly includes a housing that houses the piston and multiple anchoring slips attached to the housing. Anchoring the wellbore tool assembly within the uncollapsed tubing portion includes activating the multiple anchoring slips to anchor the housing to the uncollapsed tubing portion of the tubular member.

An aspect that can be combined with any of the other aspects includes the following features. After expanding the packer attached to the chisel head, the wellbore tool assembly is driven toward an expanded portion of the collapsed tubing portion causing the piston to be retracted into the housing.

Certain aspects of the subject matter described here can be implemented as a wellbore tool assembly. The assembly includes a chisel head, a packer, and a swivel. The chisel head is configured to be positioned within a tubular member that includes an uncollapsed tubing portion and a collapsed tubing portion. The chisel head is configured to expand a diameter of an end of the collapsed tubing portion responsive to a movement of the chisel head toward the collapsed tubing portion. The packer is attached to the chisel head. The packer is configured to expand responsive to fluidic pressure and to further expand the diameter of the collapsed tubing portion. The swivel is attached to the chisel head and the packer. The swivel is configured to permit the packer and the chisel head to rotate freely within the uncollapsed tubing portion relative to a remainder of the wellbore tool assembly.

An aspect that can be combined with any of the other aspects includes the following features. The chisel head includes a first end configured to be positioned within the end of the collapsed tubing portion, and a second end opposite the first end. The second end has an outer diameter smaller than an outer diameter of the uncollapsed tubing portion of the tubular member.

An aspect that can be combined with any of the other aspects includes the following features. At the first end, the chisel head has a substantially rectangular cross-section with a larger side dimension substantially equal to the outer diameter of the second end and a smaller side dimension smaller than a width of the collapsed tubing portion. The smaller side dimension is sufficient for the chisel head to be positioned within the end of the collapsed tubing portion.

An aspect that can be combined with any of the other aspects includes the following features. The assembly includes a piston attached to the chisel head. The piston is configured to cause the movement of the chisel head toward the collapsed tubing portion.

An aspect that can be combined with any of the other aspects includes the following features. The assembly includes a housing within which the piston is housed. The packer is attached between the housing and the chisel head. The assembly includes multiple anchoring slips attached to the housing. The multiple anchoring slips are configured, when activated, to anchor the housing to the uncollapsed tubing portion of the tubular member.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
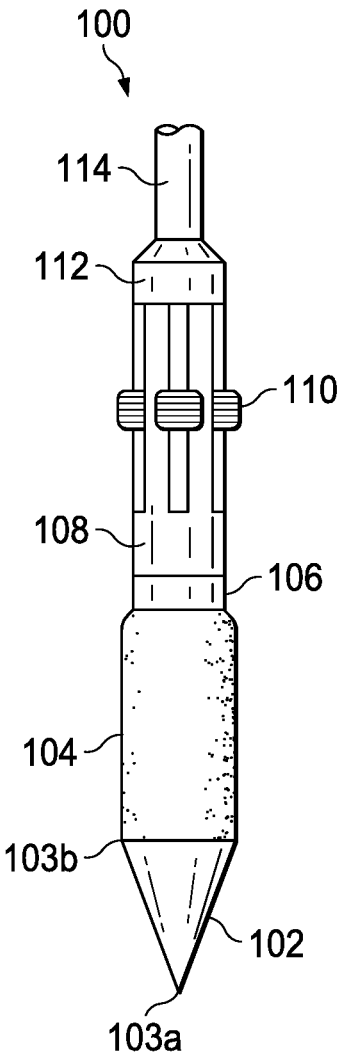
FIG. 1A is a schematic diagram of a first view of a wellbore tool assembly.

Hydrocarbon wellbores that have collapsed tubing require wellbore intervention. Collapsed tubing restricts the accessibility into the wellbore for production, logging, or work over operation. This disclosure describes a wellbore tool assembly, for example, a hydro-mechanical tool, that can be used to open and regain accessibility through a collapsed tubing section. Implementing the wellbore tool assembly described here enables opening a collapsed tubing section and regaining accessibility through the wellbore. The tool assembly and the techniques described here can be applied to open and regain accessibility through collapsed tubing of any diameter including but not limited to the casing itself.

The wellbore tool assembly is described with reference to a tubing that includes a collapsed tubing portion and an uncollapsed tubing portion, the latter being uphole relative to the former. In an uncollapsed state, the tubing has a constant inner diameter. In a collapsed state, however, an inner diameter of the collapsed tubing portion is smaller than an inner diameter of the uncollapsed tubing portion. Also, a cross-sectional shape of the collapsed tubing portion is different from a cross-sectional shape of the uncollapsed tubing portion. For example, the cross-sectional shape of the uncollapsed tubing portion can be substantially circular. In contrast, the cross-sectional shape of the collapsed tubing portion can be substantially rectangular, for example, flattened, due to formation or other pressure on diametrically opposite outer surface of the tubing. A larger side dimension of the substantially rectangular cross-section can be substantially equal to an inner diameter of the uncollapsed tubing portion. A smaller side dimension of the substantially rectangular cross-section can be smaller than the inner diameter of the uncollapsed tubing portion.

In some instances, the uncollapsed tubing portion can be downhole relative to the collapsed tubing portion. In some instances, the collapsed tubing portion can be between two uncollapsed tubing portions. The tubing with the collapsed tubing portion and the uncollapsed tubing portion can be deployed in a wellbore of any orientation, for example, vertical, horizontal, deviated, or any combination of them.

As described later, implementing the wellbore tool assembly can include deploying the wellbore tool assembly inside the uncollapsed tubing portion of the tubing to access the collapsed tubing portion. Alternatively, in an instance in which the collapsed tubing portion is at an uphole entrance to the tubing, the wellbore tool assembly can be deployed outside the tubing to access the uncollapsed tubing portion. In such instances, the wellbore tool assembly is anchored across uncollapsed tubing uphole of the uphole entrance to the collapsed tubing portion. The wellbore tool assembly is then implemented to open the uphole entrance to the collapsed tubing portion to regain access to the uncollapsed tubing portion that is downhole of the collapsed tubing portion. Also, in such instances, a landing joint with the same inner diameter as the uncollapsed tubing portion can be deployed to engage a tubing hanger above the collapsed tubing portion to be used as an anchoring seat for the wellbore tool assembly.

Figure 1B:
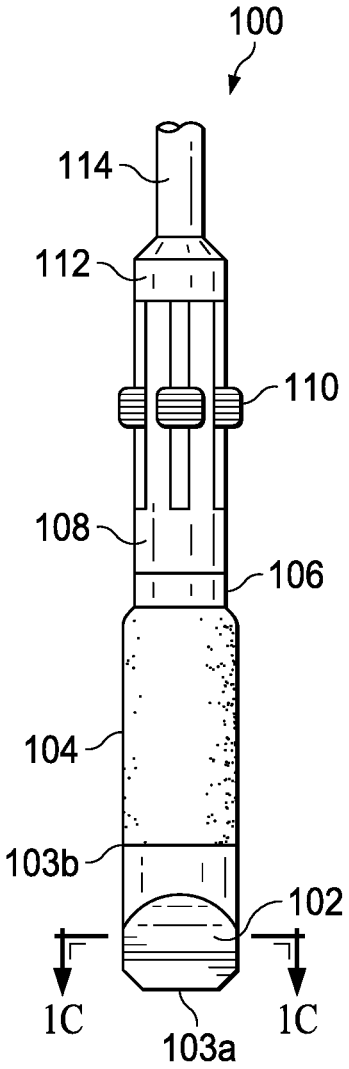
FIG. 1B is a schematic diagram of a second view of the wellbore tool assembly of FIG. 1A.

FIG. 1A is a schematic diagram of a first view of a wellbore tool assembly 100. FIG. 1B is a schematic diagram of a second view, specifically, a side view, of the wellbore tool assembly 100. The wellbore tool assembly 100 includes multiple components attached in a sequence. When deployed within the wellbore, the wellbore tool assembly 100 includes a downhole end that is near the collapsed tubing and an uphole end relatively farther away from the collapsed tubing. At the downhole end, the wellbore tool assembly 100 includes a chisel head 102 configured to expand a diameter of the collapsed tubing portion responsive to a movement of the chisel head toward the collapsed tubing portion, for example, in the downhole direction.

Figure 1C:
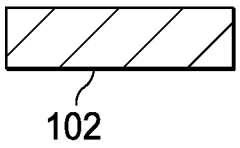
FIG. 1C is a schematic diagram of a cross-sectional view of an end of the wellbore tool assembly of FIG. 1A.

The chisel head 102 includes a first end 103*a* configured to be positioned within an end of the collapsed tubing portion. The chisel head 102 includes a second end 103*b* opposite the first end 103*a*. The second end 103*b* has an outer diameter smaller than an outer diameter of the uncollapsed tubing portion. FIG. 1C is a schematic diagram of a cross-sectional view of the first end 103*a* of the wellbore tool assembly 100. At the first end 103*a*, the chisel head 102 has a substantially rectangular cross-section with the larger side dimension substantially equal to the outer diameter of the second end 103*b*, and a smaller side dimension smaller than a width of the collapsed tubing portion. The smaller side dimension is sufficient for the chisel head 102 to be positioned within the end of the collapsed tubing portion. Along a longitudinal axis of the chisel head 102, the transverse dimension increases from the smaller side dimension to the larger side dimension. For example, the chisel head 102 tapers radially away from a longitudinal axis of the wellbore tool assembly 100 from the first end 103*a* to the second end 103*b*. In this arrangement, a longitudinal or co-axial movement of the chisel head 102 into the collapsed tubing portion causes a radial expansion of the collapsed tubing portion. The radial expansion increases the dimension, that is, the inner diameter, of the collapsed tubing portion from the smaller side dimension of the substantially rectangular cross-section of the first end 103*a* to at least the outer diameter of the second end 103*b*.

In some implementations, the chisel head 102 can be replaced with a different tool having a first end with a shape that depends on the shape of the cross-section of the collapsed tubing portion. For example, if the collapsed tubing portion has a substantially elliptical or circular cross-section, then the tool at the downhole end of the wellbore tool assembly 100 can have a corresponding cross-section of smaller dimension that will allow the wellbore tool assembly 100 to be positioned within the cross-section of the collapsed tubing portion. The chisel head 102 can be made of hardened steel or any other coating that would make the coated material stronger than the tubing. In some implementations, the surface of the chisel head 102 can be polished to reduce friction between the chisel head 102 and the collapsed tubing portion.

The wellbore tool assembly 100 includes a packer 104 attached to the chisel head 102. For example, the packer 104 is directly attached to the chisel head 102 with no intermediate components of the wellbore tool assembly 100 between the packer 104 and the chisel head 102. To do so, the packer 104 can be threadedly coupled to the chisel head 102 or fastened with fasteners such as screws or similar fasteners. When deployed, the packer 104 is uphole relative to the chisel head 102. The packer 104 is configured to expand responsive to fluidic pressure and to further expand the diameter of the collapsed tubing portion.

The wellbore tool assembly 100 includes a swivel 106 attached to the packer 104. For example, the swivel 106 is directly attached to the packer 104 with no intermediate components of the wellbore tool assembly 100 between the swivel 106 and the packer 104. When deployed, the swivel 106 is uphole relative to the packer 104. The swivel 106 is configured to permit the packer 104 and the chisel head 102 to rotate freely from a remainder of the wellbore tool assembly 100. In some implementations, the packer 104 and the chisel head 102 are rotationally coupled such that the two components co-rotate freely from the remainder of the wellbore tool assembly 100 due to the swivel 106. In some implementations, the packer 104 and the chisel head 102 are not rotationally coupled and can rotate independently from each other. The chisel head 102 can be free to rotate at the swivel 106 and can self-align alongside the inner profile of the collapsed tubing portion by multiple tagging and picking up. In some implementations, the swivel can be rotated without a motor, for example, by a quarter turn of the wellbore tool assembly. Moreover, when opening the collapsed tubing portion, the chisel head 102 need not be re-aligned. The swivel 106 is positioned uphole of the packer 104 to have the expansion effect of the packer 104 against the collapsed tubing portion directly above the chisel head 102. Doing so helps prevent the chisel head 102 from becoming mechanically stuck.

The wellbore tool assembly 100 includes a housing 108 with a piston (shown in FIGS. 2A-2G). The housing 108 is attached to the swivel 106 such that, when deployed, the housing 108 is uphole relative to the swivel 106. For example, the housing 108 is directly attached to the swivel 106 with no intermediate components of the wellbore tool assembly 100 between the housing 108 and the swivel 106. The piston is positioned within and retained by the housing 108. The piston is configured to cause the movement of the chisel 102 toward the collapsed tubing portion, for example, in the downhole direction. To do so, in some implementations, the piston is attached, for example, directly attached, to the chisel head 102. In such implementations, a piston shaft of the piston has an end secured within the housing 108 and passes through the swivel 106 and the packer 104. An opposite end of the piston shaft includes a piston head which is attached to the chisel head 102. When the piston is in a retracted state, all or substantially all of the piston shaft is retained within the housing 108. When the piston is in an extended state, the piston shaft extends out of the housing 108 in a downhole direction. When transitioning from the retracted state to the extended state, the piston shaft passes through the swivel 106 and the packer 104 to drive the chisel head 102 in the downhole direction. In some implementations, the piston is attached to the swivel 106. In such implementations, the piston shaft is secured within the housing 108 and the piston head is attached to the swivel 106. When transitioning from the retracted state into the extended state, the piston shaft pushes the swivel 106, the packer 104, and the chisel head 102 in the downhole direction.

The piston is free to move inside the housing 108 (for example, a cylindrical housing) inside of the swivel 106, the packer 104 and the chisel head 102. The housing 108 is filled with hydraulic fluid. In some implementations, a stroke of the piston (that is, a length of the piston shaft) can be equal to or greater than an axial length of the chisel head 102. Consequently, a full stroke of the piston can result in a movement of at least an entire length of the chisel head 102. At the beginning of the expansion stroke, the piston extends and pushes the chisel head 102 and the packer 104 through the collapsed tubing portion. When the chisel head 102 stops moving forwards due to high friction or side loads (or both), the piston continues to move forward within the housing 108 to pressure up the hydraulic fluid inside the packer 104 and causes the packer 104 to expand against the newly opened tubing portion. During the retraction stroke, the pressure applied to the packer 104 is removed causing the packer 104 to collapse. The chisel head 102 is then pulled out of the opened tubing portion.

Multiple anchoring slips 110 (for example, at least three or four or more anchoring slips) are attached, for example, directly attached, to the housing 108. When activated, the multiple anchoring slips 110 anchor the housing 108 to the uncollapsed tubing portion. As described earlier, when deployed, the wellbore tool assembly 100 is positioned within the uncollapsed tubing portion of the tubing uphole of the collapsed tubing portion. In this arrangement, the multiple anchoring slips 110 are activated responsive to application of fluidic pressure and activated responsive to removal of fluidic pressure. In the absence of the fluidic pressure, the multiple anchoring slips 110 reside adjacent to, for example, in contact with, an outer surface of the housing 108. When the fluidic pressure is applied, the multiple anchoring slips 110 extended radially away from the outer surface of the housing 108. The radial extension continues until the multiple anchoring slips 110 contact and anchor to an inner surface of the uncollapsed tubing portion. Once anchored, the housing 108 is longitudinally fixed relative to the uncollapsed tubing portion. That is, force in a downhole direction cannot move the anchored housing 108 relative to the uncollapsed tubing portion. With the housing 108 anchored to the uncollapsed tubing portion, a transition of the piston from the retracted state within the housing 108 to an extended state causes the movement of the chisel head 102 and, in some implementations, the packer 104, towards the collapsed tubing portion, for example, in the downhole direction. When the fluidic pressure is removed, the multiple anchoring slips 110 retract radially away from the inner surface of the uncollapsed tubing portion and towards the outer surface of the housing 108.

A safety shear release adapter 112 is attached, for example, directly attached to the housing 108, for example, to an uphole end of the housing 108. The adapter 112 releases the coiled tubing from the wellbore tool assembly 100 and allows stronger fishing equipment to engage the top profile of the fishing neck to apply jarring with a work string and retrieve the stuck wellbore tool assembly. The wellbore tool assembly 100 can be lowered into the wellbore and into the uncollapsed tubing portion of wellbore the tubing using another tubing 114, for example, coiled tubing, drilling pipe, wireline, slick line, or similar tubing. For example, a downhole end of the tubing 114 can be attached, for example, directly attached, to the safety shear release adapter 112.

Figures 2A, 2B, 2C, 2D:
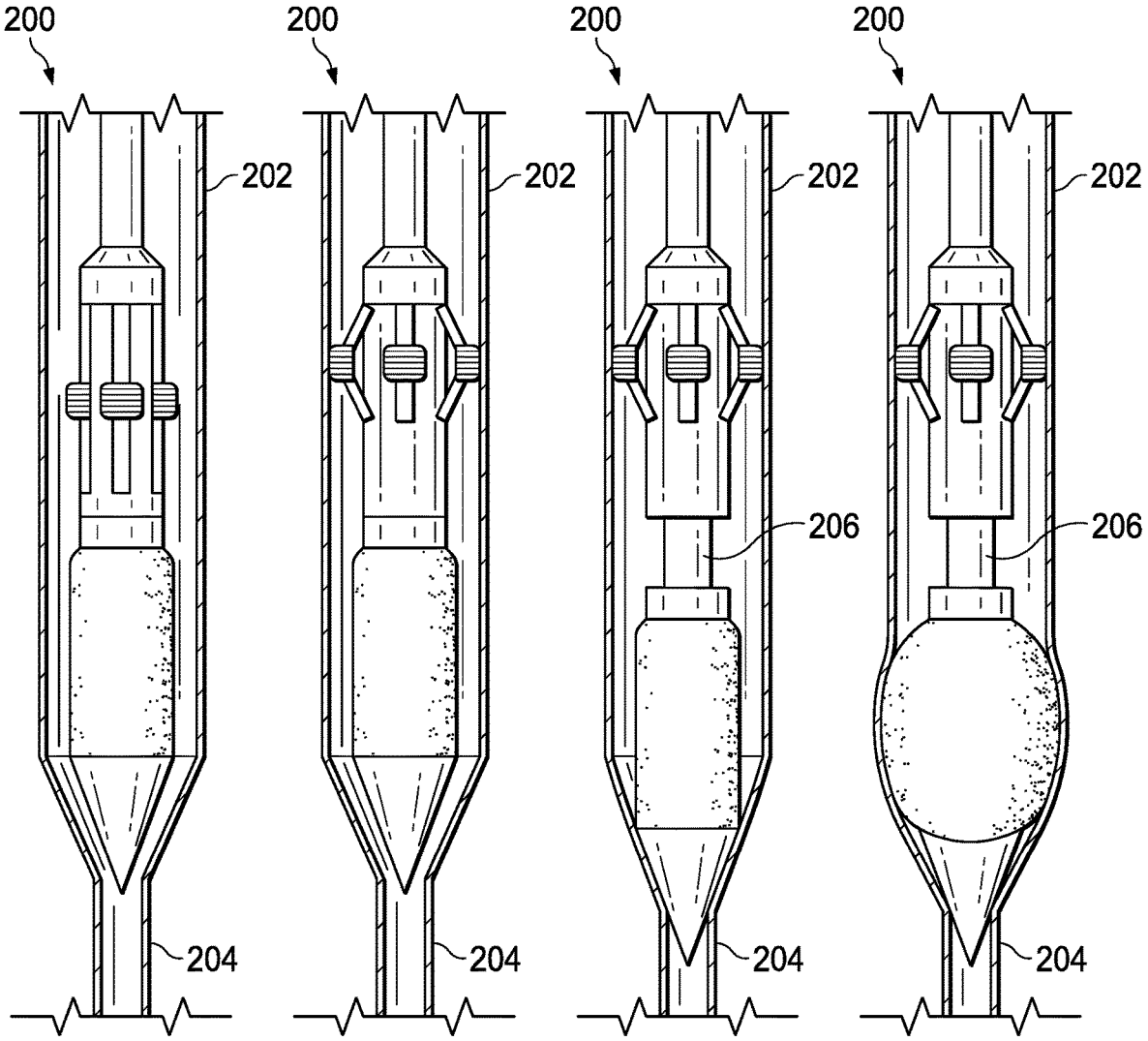
FIGS. 2A-2G are schematic diagrams of operational states of the wellbore tool assembly of FIG. 1A.
Figure 2E:
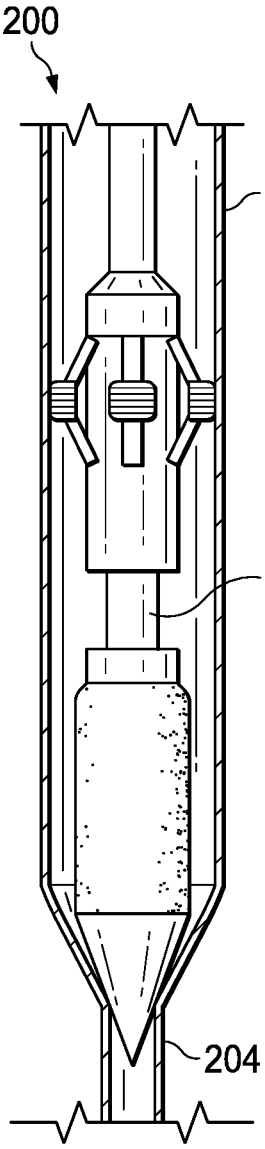
Figure 2F:
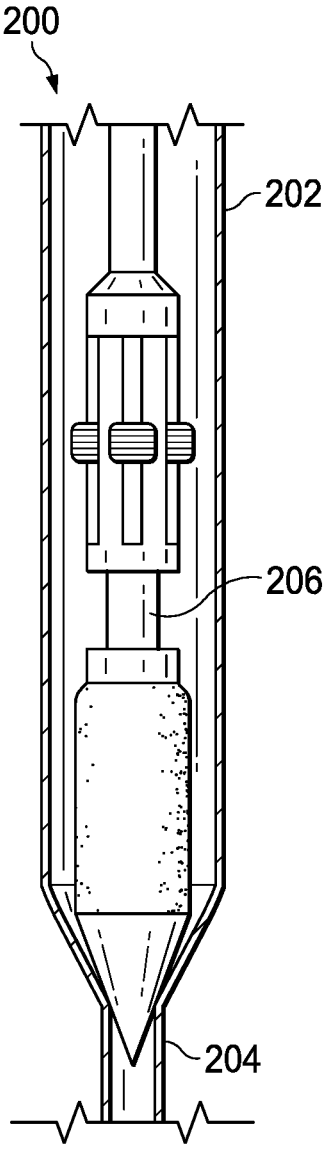
Figure 2G:
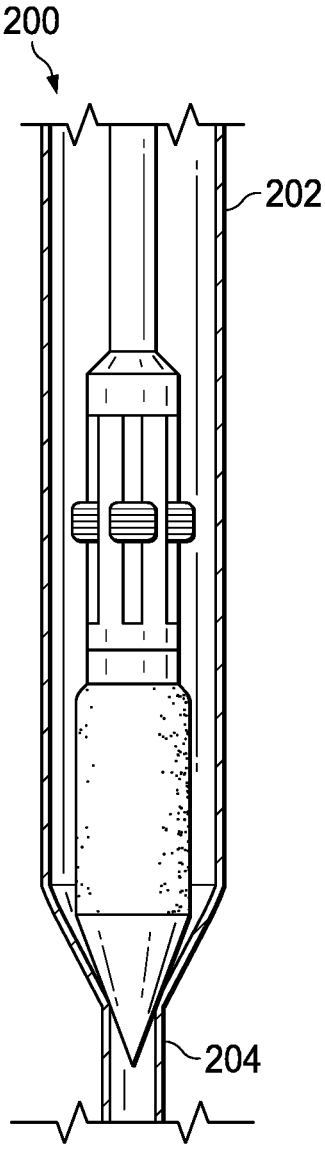
Figure 3:
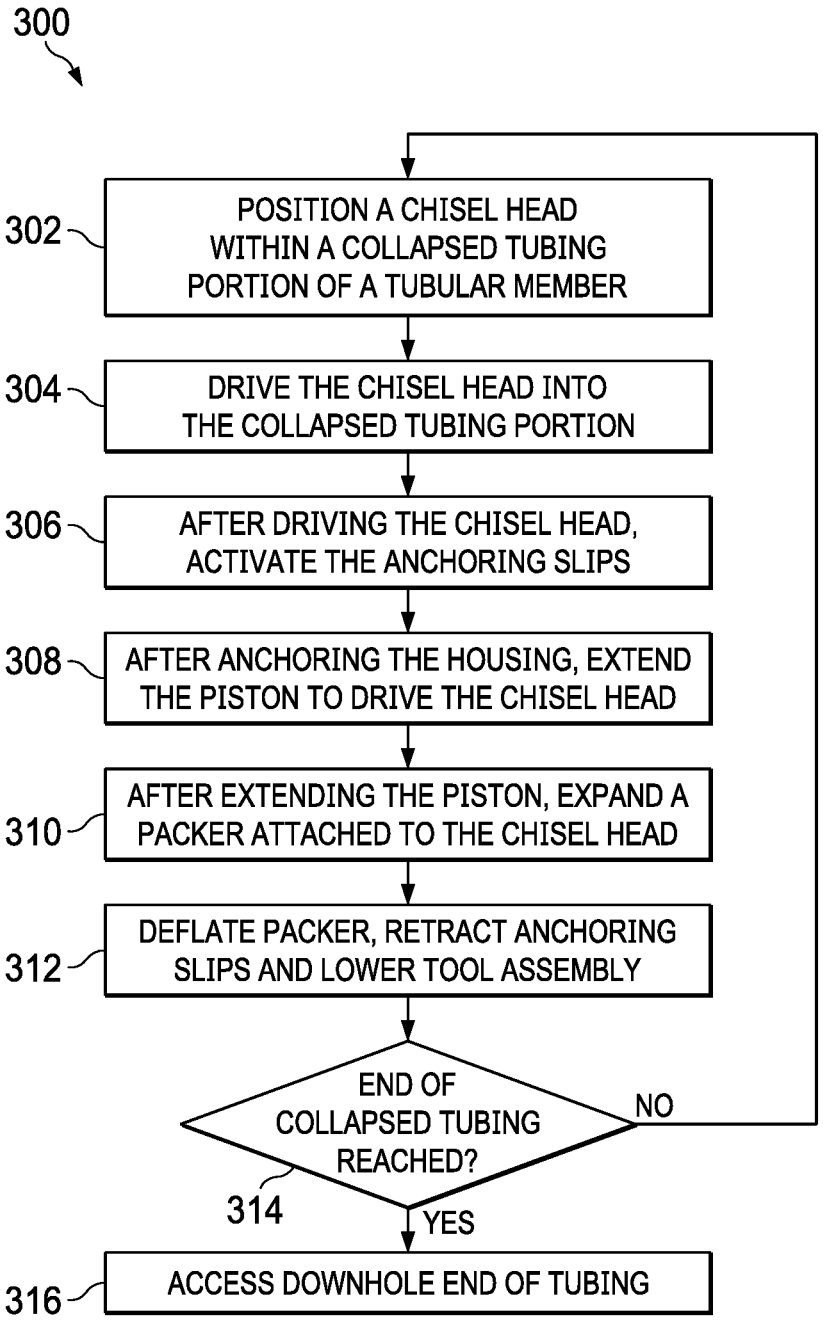
FIG. 3 is a flowchart of an example of a process of implementing the wellbore tool assembly to open collapsed tubing.

FIGS. 2A-2G are schematic diagrams of operational states of the wellbore tool assembly 100. FIG. 3 is a flowchart of an example of a process 300 of implementing the wellbore tool assembly 100 to open collapsed tubing. At 302, the chisel head 102 is positioned within a collapsed tubing portion of a tubular member. FIG. 2A shows the tubular member 200 within uncollapsed tubing portion 202 and a collapsed tubing portion 204. In the view shown in FIG. 2A, a width of the uncollapsed tubing portion 202 is greater than a width of the collapsed tubing portion 204. A width of the widest component of the wellbore tool assembly 100 (for example, the packer 104) is less than the width of the uncollapsed tubing portion 202, but greater than the width of the collapsed tubing portion 204. Therefore, the wellbore tool assembly 100 can be lowered using the tubing 114 into the uncollapsed tubing portion 202.

At 304, the chisel head 102 is driven into the collapsed tubing portion 204. A width of the first end 103*a* of the chisel head 102 is less than the width of the collapsed tubing portion 204. After the wellbore tool assembly 100 has been positioned within the uncollapsed tubing portion 202, the swivel 106 is rotated until the first end 103*a* of the chisel head 102 aligns with the end of the collapsed tubing portion 204. Once aligned, the wellbore tool assembly 100 is driven into, that is lowered or stuck into, the collapsed tubing portion 204 to access the collapsed tubing portion 204. In some implementations, the alignment of the first end 103*a* of the chisel head 102 with the end of the collapsed tubing portion 204 can be determined by incrementally rotating (for example, in 90 degree or quarter turn increments) the swivel 106 and driving the wellbore tool assembly 100 toward the collapsed tubing portion 204 until the first end 103*a* enters the collapsed tubing portion 204. Depending on a position of the swivel 106 in the wellbore tool assembly 100, rotating the swivel 106 either rotates the chisel head 102 relative to a remainder of the wellbore tool assembly 100 or co-rotates the packer 104 and the chisel head 102 relative to a remainder of the wellbore tool assembly 100.

At 306, after driving the chisel head 102 into the collapsed tubing portion 204, the anchoring slips 110 are activated. FIG. 2B shows the anchoring slips 110 in an activated state and the housing 108 in an anchored state. To activate the anchoring slips 110, in some implementations, a ball is dropped from a surface of the wellbore to close circulation ports of the anchoring slips 110. After the ball has landed and sealed the circulation ports, pressure is increased, for example, by flowing fluid through the tubing 114 towards the anchoring slips 110. As described earlier, the anchoring slips 110 extend radially away from the outer surface of the housing 108 and contact and anchor to an inner wall of the uncollapsed tubing portion 202.

At 308, after anchoring the housing 108 to the uncollapsed tubing portion 202, the piston 206, which is in a retracted state within the housing 108, is extended. FIG. 2C shows the piston 206 in the extended state. To do so, the pressure applied through the tubing 114 is further increased. The increase in the pressure causes the piston 206 to transition from the retracted state to the extended state in which the piston drives the chisel head 102 into the collapsed tubing portion 204. In the schematic shown in FIG. 2C, the piston 206 is connected to the swivel 106 and drives the combination of the swivel 106, the packer 104, and the chisel head 102 into the collapsed tubing portion 204. As the piston 206 drives the chisel head 102 towards and into the collapsed tubing portion 204 and, because the stroke of the piston is at least equal to an axial length of the chisel head 102, the inner diameter of the collapsed tubing portion 204 increases to at least an outer diameter of the second end 103*b* of the chisel head 102. In this manner, extending the piston 206 towards the collapsed tubing portion 204 initiates an expansion of the collapsed tubing portion 204. In some instances, extending the piston 206 also causes at least a portion of the packer 104 to be positioned within a portion of the collapsed tubing portion 204 that has been expanded by the chisel head 102.

At 310, after extending the piston 206, the packer 104 is expanded. To do so, the pressure applied through the tubing 114 is further increased causing the packer to expand at least radially as well as in other directions. FIG. 2D shows the packer 104 in an expanded state. The expansion of the packer 104 applies a force on an inner surface of the collapsed tubing portion 204 beyond the elastic limit of the collapsed tubing portion 204, thereby further expanding the collapsed tubing portion 204 to provide additional clearance. In this manner, the wellbore tool assembly 100 has been implemented to expand a portion of the collapsed tubing portion 204.

At 312, after expanding a portion of the collapsed tubing portion 204, the packer 104 is deflated. FIG. 2E shows the packer 104 in a deflated state. Next, the multiple anchoring slips 110 are retracted. FIG. 2F shows the multiple anchoring slips 110 in the retracted state. Then, the wellbore tool assembly 100 is driven towards the collapsed tubing portion 204. To implement process step 312, the pressure applied through the tubing 114 is gradually decreased. Doing so causes the piston 206 to be retracted within the housing 108. FIG. 2G shows the wellbore tool assembly 100 having being lowered towards the collapsed tubing portion 204 and the piston 206 having being retracted within the housing 108.

At 314, a check is implemented to determine whether the end of the collapsed tubing portion 204 has been reached. If the end has not been reached, that is, additional collapsed tubing portion 204 remains, then the process steps 302, 304, 306, 308, 310, and 312 are repeated until the end of the collapsed tubing portion 204 has been reached. In some implementations, the presence or absence of additional collapsed tubing portion 204 can be determined by driving the wellbore tool assembly 100 in the downhole direction. Free movement of the wellbore tool assembly 100 in the downhole direction indicates that the end of the collapsed tubing portion 204 has been reached and that the entirety of the collapsed tubing portion 204 has been expanded. Conversely, restricted movement or sticking of the wellbore tool assembly 100, when driven in the downhole direction indicates the presence of additional collapsed tubing portion 204. If the end has been reached, then, at 316, the downhole end of the tubing 114 is accessed. The wellbore tool assembly 100 can then be tripped out of the tubing and the wellbore.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A wellbore tool assembly comprising: a chisel head comprising: a first end configured to be positioned within an end of a collapsed tubing portion of a tubular member; and a second end opposite the first end, the second end having an outer diameter smaller than an outer diameter of an uncollapsed tubing portion of the tubular member, the chisel head configured to expand a diameter of the collapsed tubing portion responsive to a movement of the chisel head toward the collapsed tubing portion; a packer attached to the chisel head, the packer configured to expand responsive to fluidic pressure and to further expand and inflate the diameter of the collapsed tubing portion; and a piston attached to the chisel head, the piston configured to cause the movement of the chisel head toward the collapsed tubing portion.

2. The wellbore tool assembly of claim 1, wherein, at the first end, the chisel head has a substantially rectangular cross-section with a larger side dimension substantially equal to the outer diameter of the second end and a smaller side dimension smaller than a width of the collapsed tubing portion, the smaller side dimension sufficient for the chisel head to be positioned within the end of the collapsed tubing portion.

3. The wellbore tool assembly of claim 1, further comprising a housing within which the piston is housed, the packer attached between the housing and the chisel head.

4. The wellbore tool assembly of claim 3, further comprising a plurality of anchoring slips attached to the housing, the plurality of anchoring slips configured, when activated, to anchor the housing to the uncollapsed tubing portion of the tubular member.

5. The wellbore tool assembly of claim 4, wherein the plurality of anchoring slips are configured to be activated responsive to application of fluidic pressure and de-activated responsive to removal of the fluidic pressure.

6. The wellbore tool assembly of claim 4, wherein, with the housing anchored to the uncollapsed tubing portion of the tubular member, the piston is configured to cause the chisel head and the packer to move toward the collapsed tubing portion.

7. The wellbore tool assembly of claim 3, further comprising a swivel attached between the housing and the packer, the swivel configured to permit the packer and the chisel head to rotate freely from the housing.

8. The wellbore tool assembly of claim 1, wherein the packer and the chisel head are rotationally coupled.

9. A method comprising: positioning a chisel head at an end of a wellbore tool assembly within a collapsed tubing portion of a tubular member comprising an uncollapsed tubing portion; driving the chisel head into the collapsed tubing portion to expand the collapsed tubing portion; and after driving the chisel head into the collapsed tubing portion, expanding and inflating a packer attached to the chisel head to further expand the collapsed tubing portion.

10. The method of claim 9, wherein the chisel head has a substantially rectangular cross-section with a larger side dimension and a smaller side dimension smaller than a width of the collapsed tubing portion, the smaller side dimension sufficient for the chisel head to be positioned within the end of the collapsed tubing portion, wherein positioning the chisel head within the collapsed tubing portion comprises rotating the chisel head within the uncollapsed tubing portion relative to the collapsed tubing portion until the smaller side dimension of the chisel head aligns with the width of the collapsed tubing portion.

11. The method of claim 10, wherein the packer and the chisel head are rotationally coupled, wherein rotating the chisel head comprises rotating the packer and the chisel head together.

12. The method of claim 10, wherein the wellbore tool assembly further comprises a piston attached to the packer and the chisel head, wherein driving the chisel head into the collapsed tubing portion comprises extending the piston toward the collapsed tubing portion.

13. The method of claim 12, further comprising anchoring the wellbore tool assembly within the uncollapsed tubing portion before extending the piston toward the collapsed tubing portion.

14. The method of claim 13, wherein the wellbore tool assembly further comprises a housing that houses the piston and a plurality of anchoring slips attached to the housing, wherein anchoring the wellbore tool assembly within the uncollapsed tubing portion comprises activating the plurality of anchoring slips to anchor the housing to the uncollapsed tubing portion of the tubular member.

15. The method of claim 12, further comprising after expanding the packer attached to the chisel head, driving the wellbore tool assembly toward an expanded portion of the collapsed tubing portion causing the piston to be retracted into the housing.

16. A wellbore tool assembly comprising: a chisel head configured to be positioned within a tubular member comprising an uncollapsed tubing portion and a collapsed tubing portion, the chisel head configured to expand a diameter of an end of the collapsed tubing portion responsive to a movement of the chisel head toward the collapsed tubing portion; a packer attached to the chisel head, the packer configured to expand and inflate responsive to fluidic pressure and to further expand the diameter of the collapsed tubing portion; and a swivel attached to the chisel head and the packer, the swivel configured to permit the packer and the chisel head to rotate freely within the uncollapsed tubing portion relative to a remainder of the wellbore tool assembly.

17. The wellbore tool assembly of claim 16, wherein the chisel head comprises:

a first end configured to be positioned within the end of the collapsed tubing portion; and a second end opposite the first end, the second end having an outer diameter smaller than an outer diameter of the uncollapsed tubing portion of the tubular member.

18. The wellbore tool assembly of claim 17, wherein, at the first end, the chisel head has a substantially rectangular cross-section with a larger side dimension substantially equal to the outer diameter of the second end and a smaller side dimension smaller than a width of the collapsed tubing portion, the smaller side dimension sufficient for the chisel head to be positioned within the end of the collapsed tubing portion.

19. The wellbore tool assembly of claim 16, further comprising:

a piston attached to the chisel head, the piston configured to cause the movement of the chisel head toward the collapsed tubing portion;

a housing within which the piston is housed, the packer attached between the housing and the chisel head; and a plurality of anchoring slips attached to the housing, the plurality of anchoring slips configured, when activated, to anchor the housing to the uncollapsed tubing portion of the tubular member.

* * * * *